US006601476B2

(12) United States Patent
Hu

(10) Patent No.: US 6,601,476 B2
(45) Date of Patent: Aug. 5, 2003

(54) ADAPTOR DEVICE FOR A WRENCH

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 10/094,344

(22) Filed: Mar. 8, 2002

(65) Prior Publication Data

US 2003/0097913 A1 May 29, 2003

(30) Foreign Application Priority Data

Nov. 28, 2001 (TW) ..... 90220754 U

(51) Int. Cl.[7] ..... B25B 13/46
(52) U.S. Cl. ..... 81/60; 81/176.1; 81/177.85; 81/180.1
(58) Field of Search ..... 81/60–63.2, 176.1, 81/177.85, 180.1, 177.1

(56) References Cited

U.S. PATENT DOCUMENTS 4,738,168 A * 4/1988 Carminati ..... 81/125
4,991,468 A * 2/1991 Lee ..... 81/60
5,619,890 A * 4/1997 Hattori et al. ..... 81/59.1
5,901,620 A * 5/1999 Arnold ..... 81/63.2
6,003,414 A * 12/1999 Hsieh ..... 81/177.85
6,006,631 A * 12/1999 Miner et al. ..... 81/177.85
6,257,096 B1 * 7/2001 Ling ..... 81/60

* cited by examiner

*Primary Examiner*—Joseph J. Hail, III
*Assistant Examiner*—David B. Thomas
(74) *Attorney, Agent, or Firm*—Alan D. Kamrath; Rider, Bennett, LLP.

(57) ABSTRACT

An adaptor device comprises an adaptor and a retainer. The adaptor includes a first end removably mounted in a box end of a wrench and a second end releasably engaged with an object such as a socket. The retainer is fixed to the first end of the adaptor and includes a plurality of radially extending resilient retaining sections on an outer periphery thereof, a slit being defined between two of the resilient retaining sections that are adjacent to each other. The resilient retaining sections are engaged with an inner periphery of the box end of the wrench, thereby providing an engaging force between the resilient retaining sections and the box end. At least one of the resilient retaining sections includes a stop that abuts against an end face of the box end of the wrench.

17 Claims, 11 Drawing Sheets

ADAPTOR DEVICE FOR A WRENCH

BACKGROUND OF THE INVENTION

1. Field of the Invention

The present invention relates to an adaptor device for a wrench. In particular, the present invention relates to an adaptor device that can be attached to a box end of a wrench, allowing the wrench to engage with a socket and allowing easy removal of the socket from the adaptor device without causing disengagement of the adaptor from the wrench.

2. Description of the Related Art

U.S. Pat. No. 6,257,096 to Ling issued on Jul. 10, 2001 discloses a socket adaptor that can be mounted into a box end of a ratchet-type ring spanner. The socket adaptor includes a disc on an end thereof, two hexagonal members on an intermediate portion thereof, and a socket engaging portion on the other end thereof. An annular groove is defined between the hexagonal members for receiving an O-ring that is engaged in a ratchet wheel mounted in the box end of the ratchet-type ring spanner. Thus, the O-ring retains the socket adaptor in the ratchet wheel, allowing the ratchet-type ring spanner to be used with sockets. However, the retaining force provided by the O-ring is weak such that the O-ring tends to move relative to the ratchet wheel when the socket adaptor is subject to a force perpendicular to a longitudinal axis of the ring spanner. Further, the O-ring wears quickly due to friction and thus loses its retaining function. Further, the disc is in friction contact with and thus damages a web area of the ratchet-type ring spanner when the ratchet-type ring spanner is moving in a free rotating direction opposite to the ratcheting direction for driving a fastener.

SUMMARY OF THE INVENTION

An object of the present invention is to provide an adaptor device that can be attached to a box end of a wrench, allowing the wrench to engage with a socket and allowing easy removal of the socket from the adaptor device without causing disengagement of the adaptor device from the wrench.

In accordance with a first aspect of the invention, an adaptor device is removably mounted in a box end of a wrench and comprises:

an adaptor including a first end adapted to be removably mounted in a box end of a wrench and a second end adapted to be releasably engaged with an object; and a retainer fixed to the first end of the adaptor, the retainer including a plurality of radially extending resilient retaining sections on an outer periphery thereof, a slit being defined between two of said resilient retaining sections that are adjacent to each other, said resilient retaining sections being adapted to engage with an inner periphery of the box end of the wrench, thereby providing an engaging force between the resilient retaining sections and the box end, at least one of said resilient retaining sections including a stop adapted to abut against an end face of the box end of the wrench.

In accordance with a second aspect of the invention, an adaptor device is removably mounted in a box end of a wrench and comprises:

an adaptor including a first end adapted to be removably mounted in a box end of a wrench and a second end adapted to be releasably engaged with an object; and a retainer fixed to the first end of the adaptor, the retainer including a plurality of radially extending resilient retaining sections and a plurality of stops alternately formed on an outer periphery thereof, a slit being defined between each said resilient retaining section and an associated one of said stops, said resilient retaining sections being adapted to engage with an inner periphery of the box end of the wrench, thereby providing an engaging force between the resilient retaining sections and the box end, said stops being adapted to abut against an end face of the box end of the wrench.

In accordance with a third aspect of the invention, a combination of an adaptor device and a wrench is provided and comprises:

a wrench having a box end, the box end having a first end and a second end opposite to the first end;

an adaptor including a first end removably mounted in the box end of the wrench and a second end adapted to be releasably engaged with an object, the first end of the adaptor including a flange abutting against an end face of the first end of the box end of the wrench, the adaptor further including a mounting section between the first end of the adaptor and the second end of the adaptor; and a retainer fixed to the mounting section of the adaptor, the retainer including at least two resilient retaining sections on an outer periphery thereof, a slit being defined between said at least two resilient retaining sections, said at least two resilient retaining sections abutting against the second end of the box end of the wrench, thereby providing an engaging force between the resilient retaining sections and the box end.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
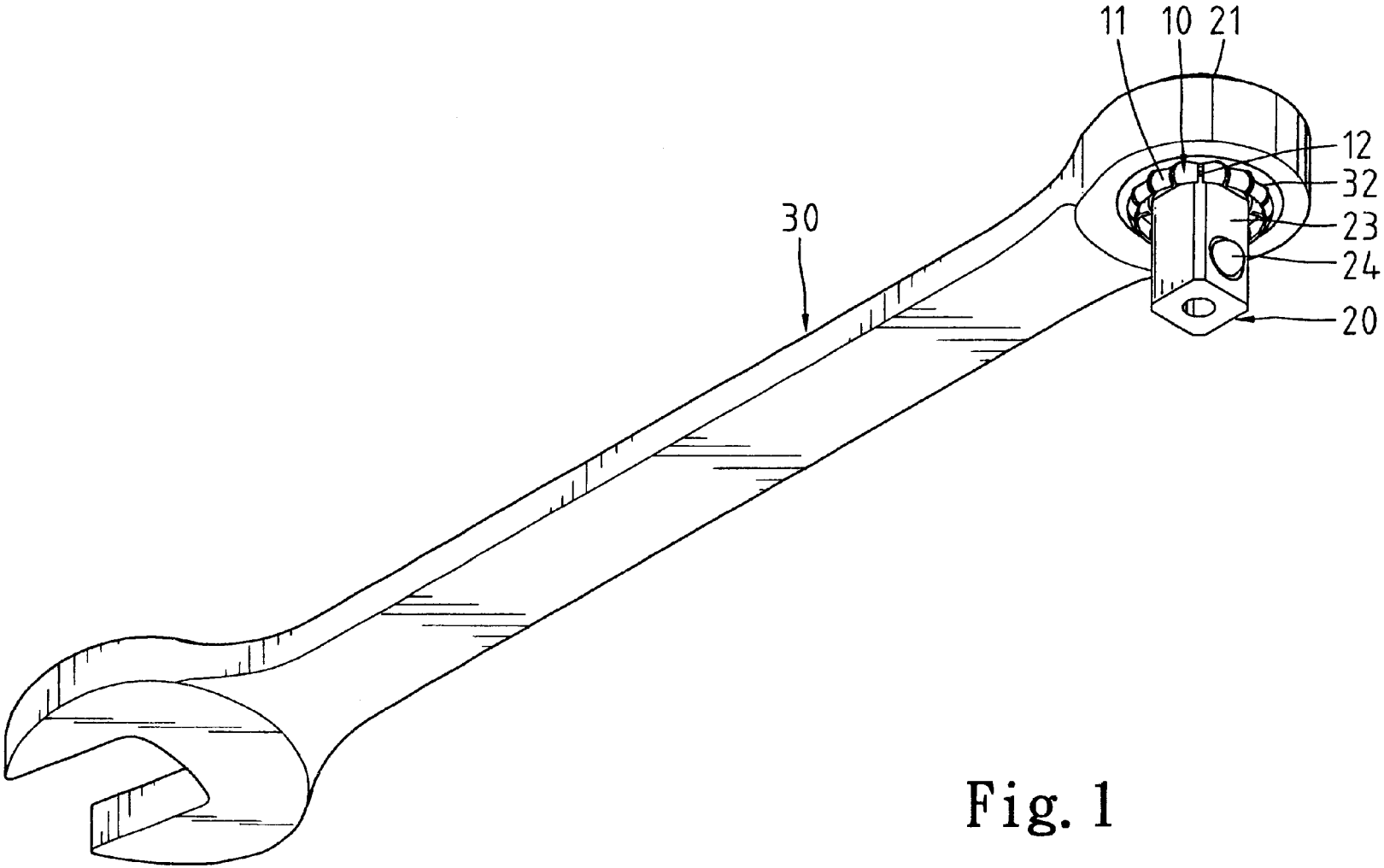
FIG. 1 is a perspective view of a wrench and an adaptor device in accordance with the present invention.
Figure 2:
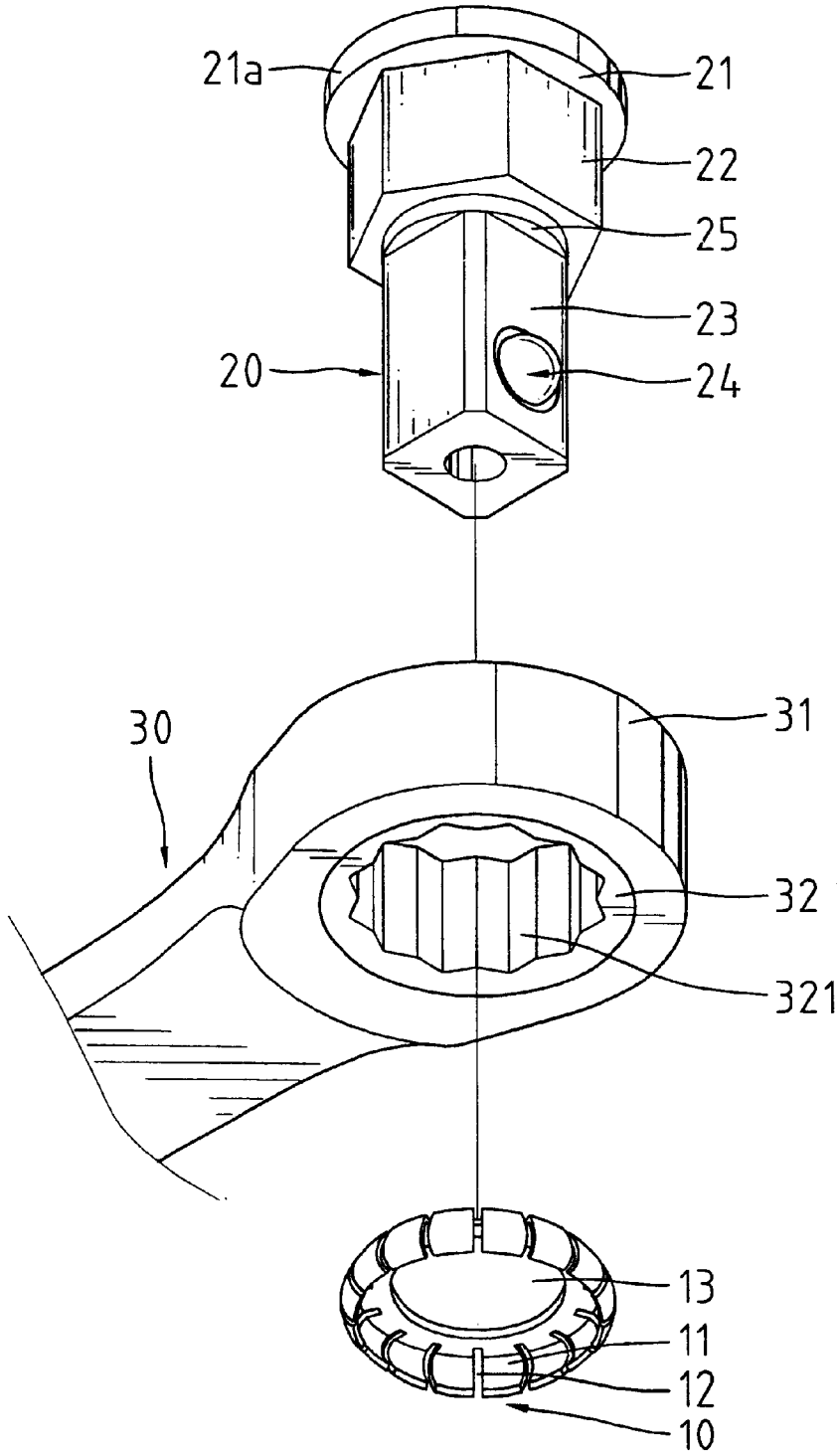
FIG. 2 is an exploded perspective view of the wrench and the adaptor device in accordance with the present invention.

Referring to FIG. 1, an adaptor device for a wrench in accordance with the present invention generally comprises a retainer 10 and an adaptor 20 to be attached to a box end 31 of a wrench 30. The retainer 10 includes at least two resilient retaining sections 11 on an outer periphery thereof. In this embodiment, a plurality of radially extending resilient retaining sections 11 is formed along the outer periphery of the retainer 10 with a slit 12 being defined between each two retaining sections 11 that are adjacent to each other. Thus, each of the resilient retaining sections 11 has its resiliency. Each resilient retaining section 11 is preferably convex in an intermediate portion thereof and extends in a direction perpendicular to a general plane of the retainer 10. The shape of the resilient retaining sections 11 may vary according to need.

Figure 4:
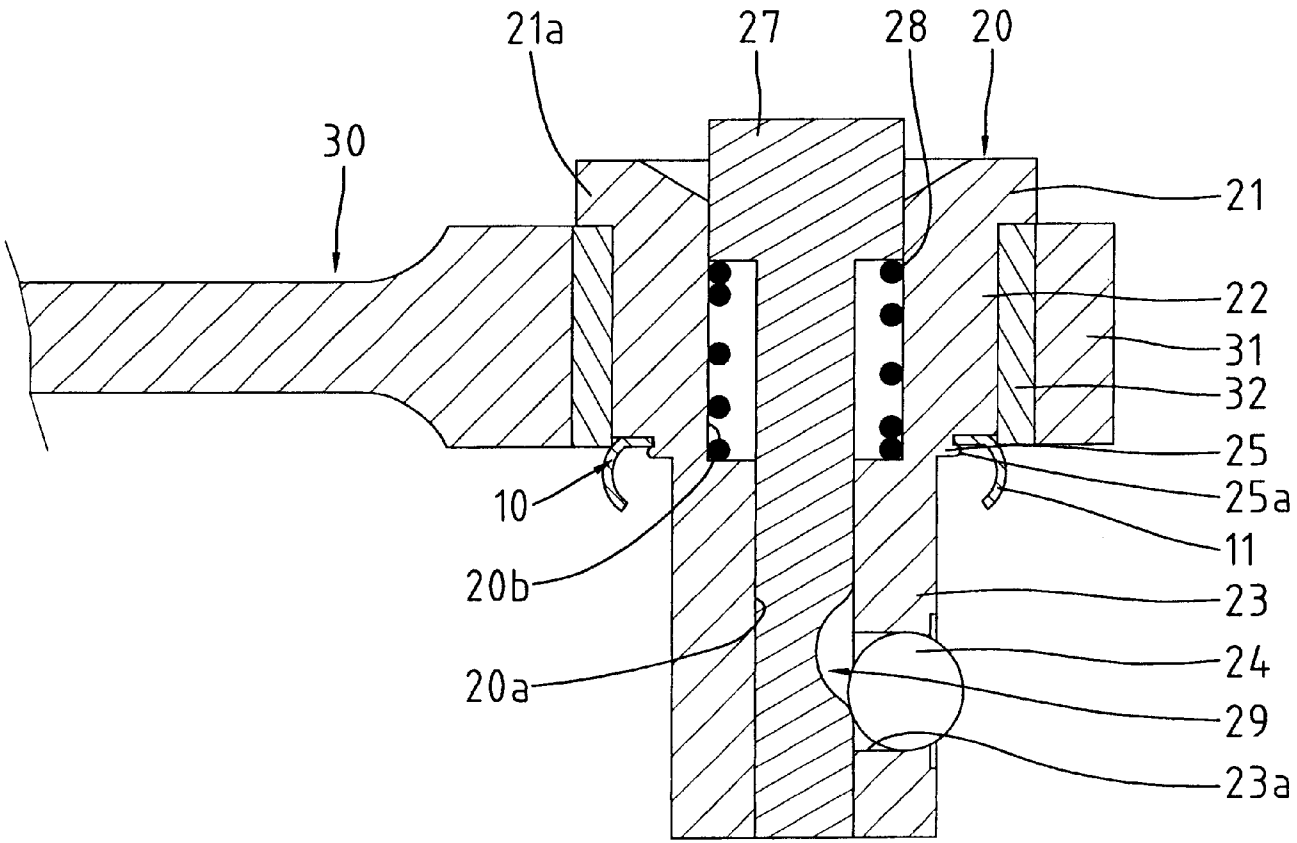
FIG. 4 is a sectional view similar to FIG. 3, wherein the adaptor device is in position.

The adaptor 20 includes a first end 21 and a second end 23. In this embodiment, the first end 21 of the adaptor 20 includes a polygonal engaging portion 22 that is engaged in the box end 31 of the wrench 30. Further, the first end 21 of the adaptor 20 includes a flange 21*a* above the engaging portion 22. The second end 23 of the adaptor 20 forms a drive section for releasably engaging with a socket (not shown). As illustrated in FIG. 4, a transverse hole 23*a* is defined in the second end 23 of the adaptor 20 for receiving a ball 24. The adaptor 20 further includes a longitudinal hole 20*a* for receiving a push pin 27. The push pin 27 includes a groove 29 for receiving the ball 24 when removal of the socket from the drive section 23 is required. An elastic element 28 is mounted around the push pin 27 and located in an enlarged section 20*b* of the longitudinal hole 20*a* of the adaptor 20. The push pin 27 is pushed when removal of the socket from the drive section 23 is required. Further, the adaptor 20 includes a mounting section 25 adjacent to the engaging portion 22. The retainer 10 is mounted around the mounting section 25 which is then riveted to form an annular lip 25*a* for fixing the retainer 10 to the adaptor 20.

The wrench 30 includes a handle (not labeled) and a box end 31 extending from the handle. A drive member 32 is mounted in the box end 31 and includes a hole 321 for engaging with and driving a fastener. A switch member (not shown) may be mounted to the handle for switching ratcheting directions of the wrench 30, which is conventional and therefore not described in detail.

Figure 3:
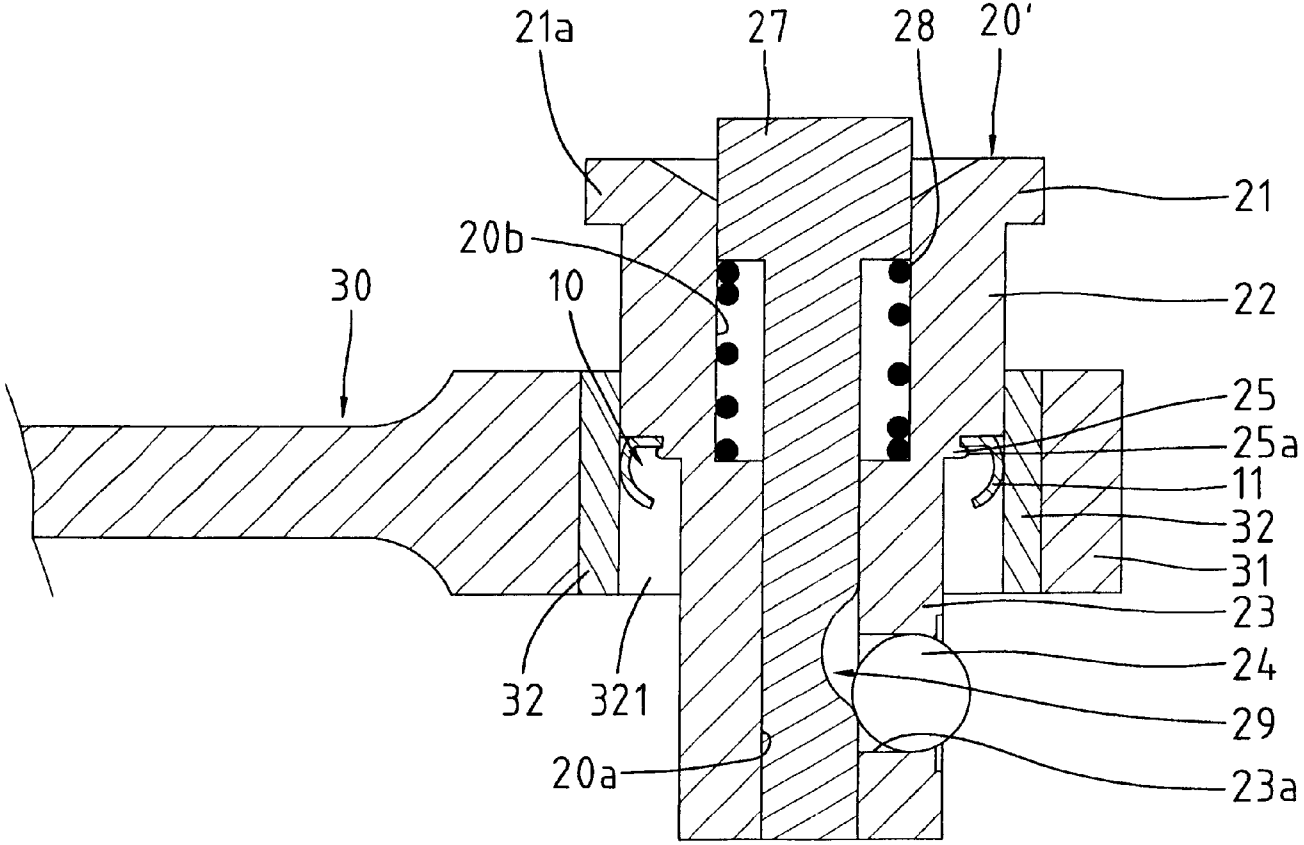
FIG. 3 is a sectional view illustrating mounting of the adaptor device into a box end of the wrench.

In assembly, as shown in FIG. 3, the second end 23 of the adaptor 20 is inserted from an end of the drive member 32 through the hole 321 of the drive member 32 until the flange 21*a* of the adaptor 20 abuts against an end face of the end of the drive member 32. A larger force is required to force the resilient retaining sections 11 to pass through the end of the drive member 32. As can be seen in FIG. 3, the resilient retaining sections 11 are compressed inward. Referring to FIG. 4, when the second end 23 of the retainer 10 passes through the other end of the drive member 32, the resilient retaining sections 11 resume their shapes and thus abut against an edge of the other end of the drive member 32. It is noted that a diameter of the annularly disposed resilient retaining sections 11 is greater than a diameter of the hole 321 of the drive member 32, it is impossible to disengage the adaptor 20 from the drive member 32 unless a relatively large force is applied in a direction opposite to the mounting direction. Thus, the wrench 30 can be used with a socket through the use of the retainer 10.

Figure 5:
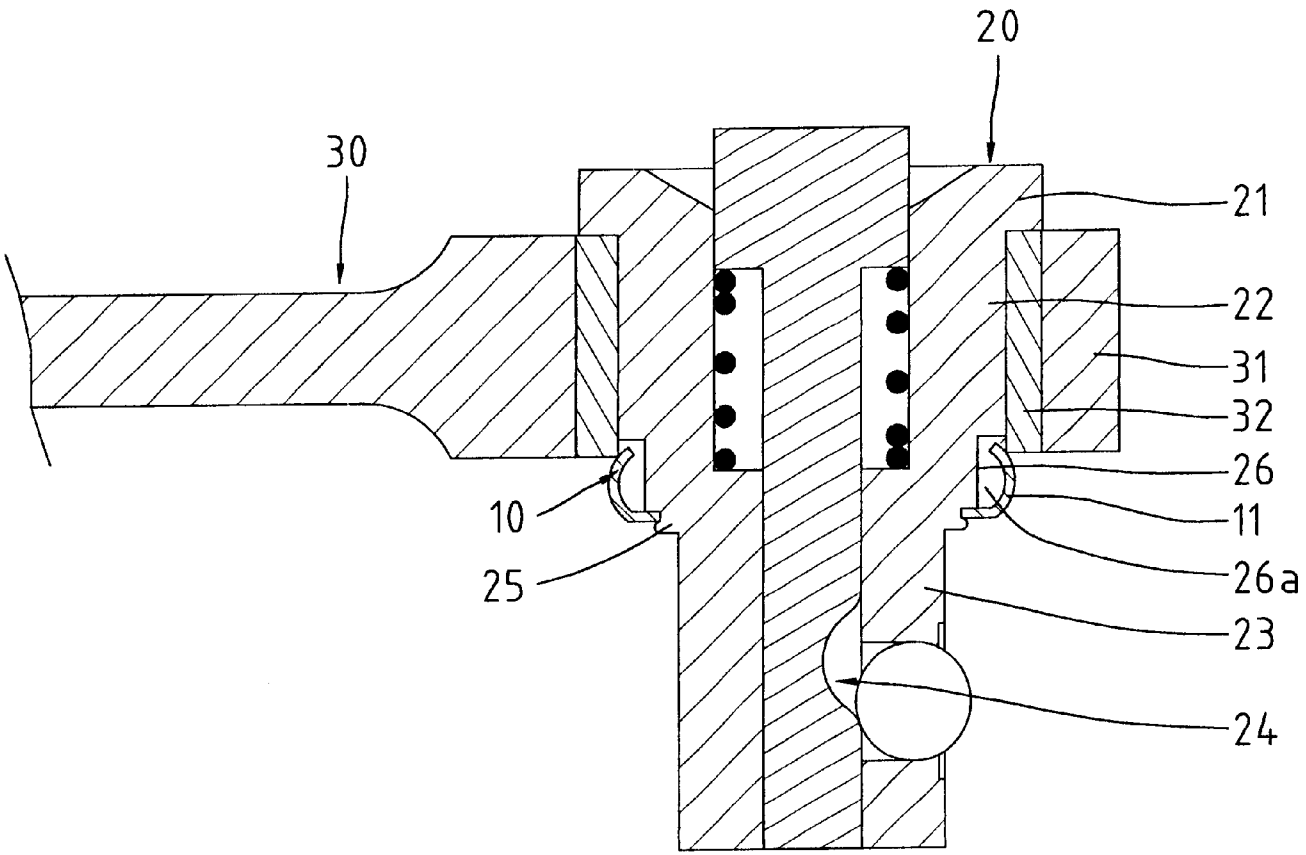
FIG. 5 is a sectional view similar to FIG. 4, illustrating a modified embodiment of the adaptor device.

As mentioned above, the user may apply a relatively large force sufficient to overcome the engaging force between the resilient retaining sections 11 and the other end of the drive member 32 when removal of the adaptor 20 is required. The resilient retaining sections 11 are compressed for subsequently passing through the hole 321 of the drive member 32. FIG. 5 illustrates a modified embodiment of the invention, wherein like numerals denote like elements. In this embodiment, a reduced section 26 is formed between the engaging portion 22 and the mounting section 25 of the adaptor 20, and the retainer 10 is fixed to the mounting section 25 of the adaptor 20 in an inverted state without affecting its function. It is noted that the resilient retaining section 11 is located in a space 26*a* surrounding the reduced section 26.

Figure 6:
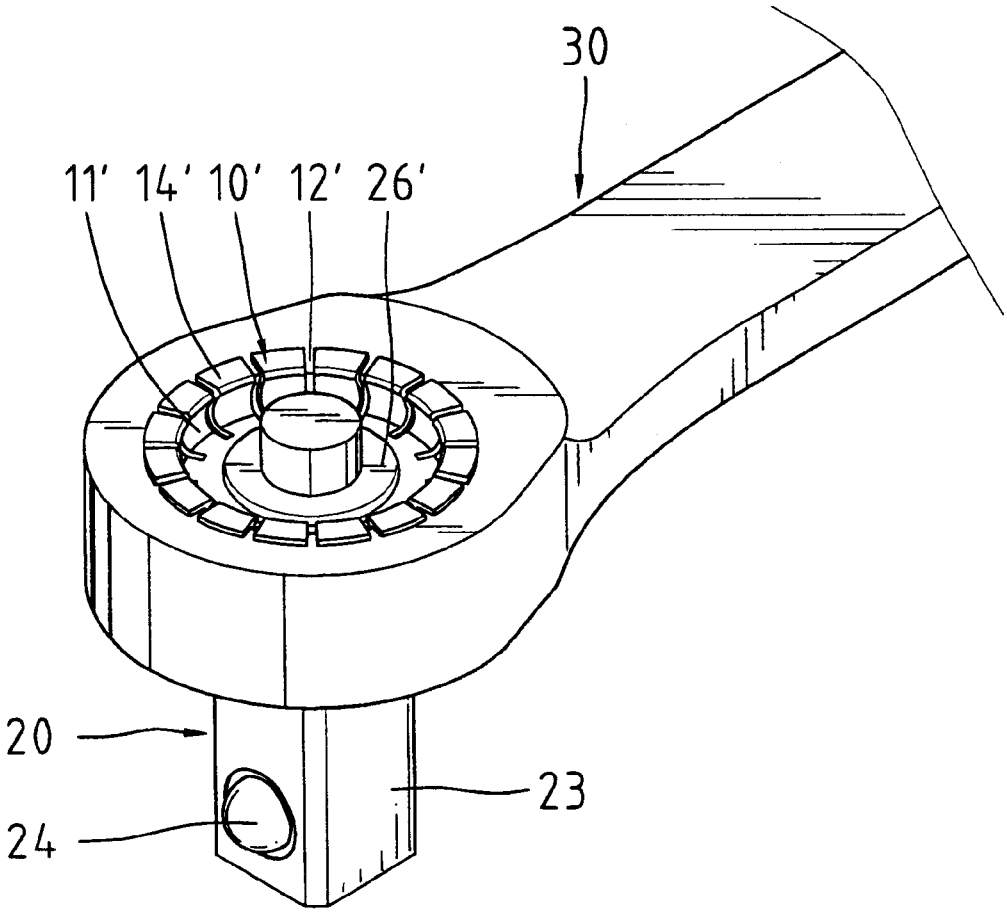
FIG. 6 is a perspective view of a wrench and another modified embodiment of the adaptor device in accordance with the present invention.
Figure 7:
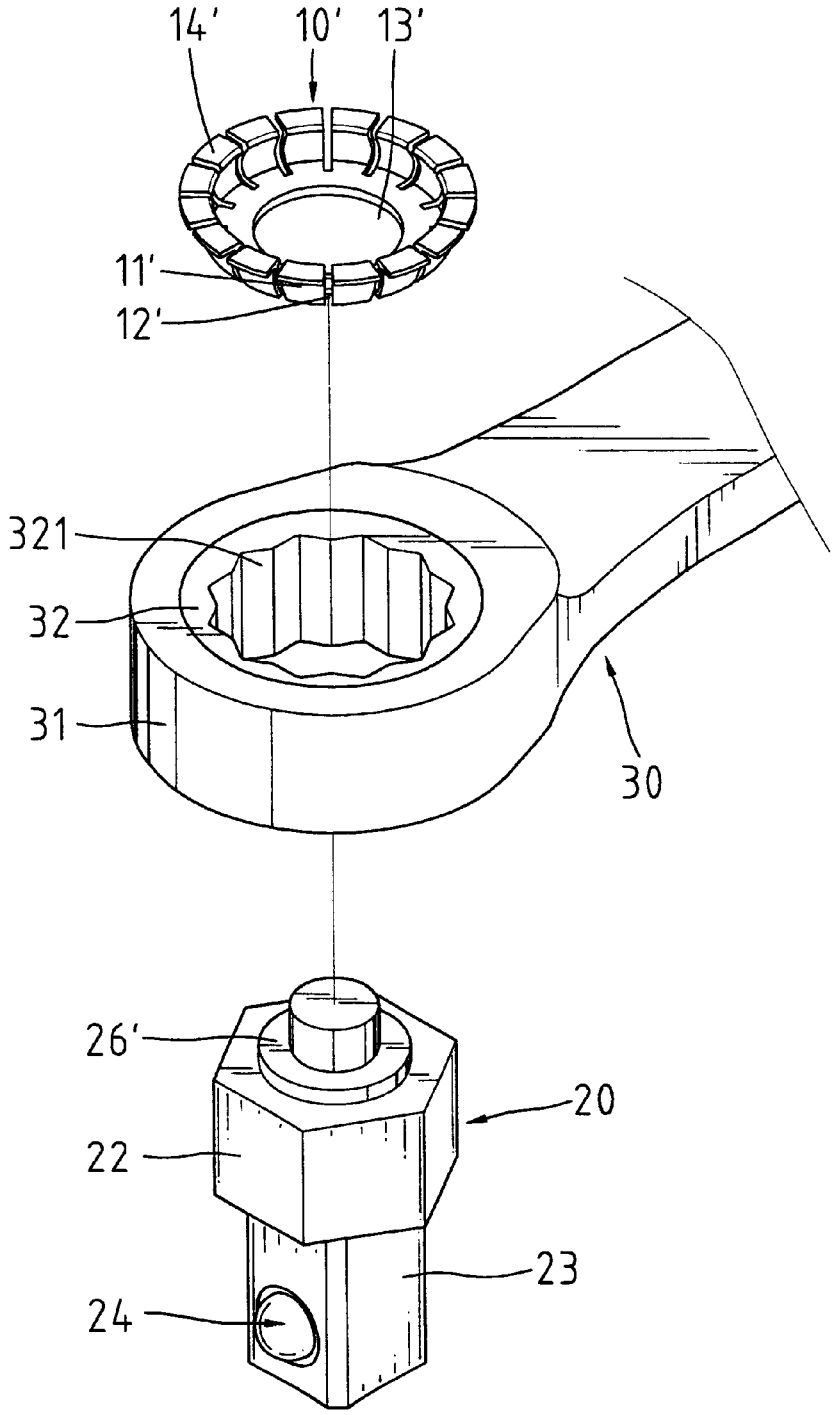
FIG. 7 is an exploded perspective view of the wrench and the adaptor device in FIG. 6.
Figure 8:
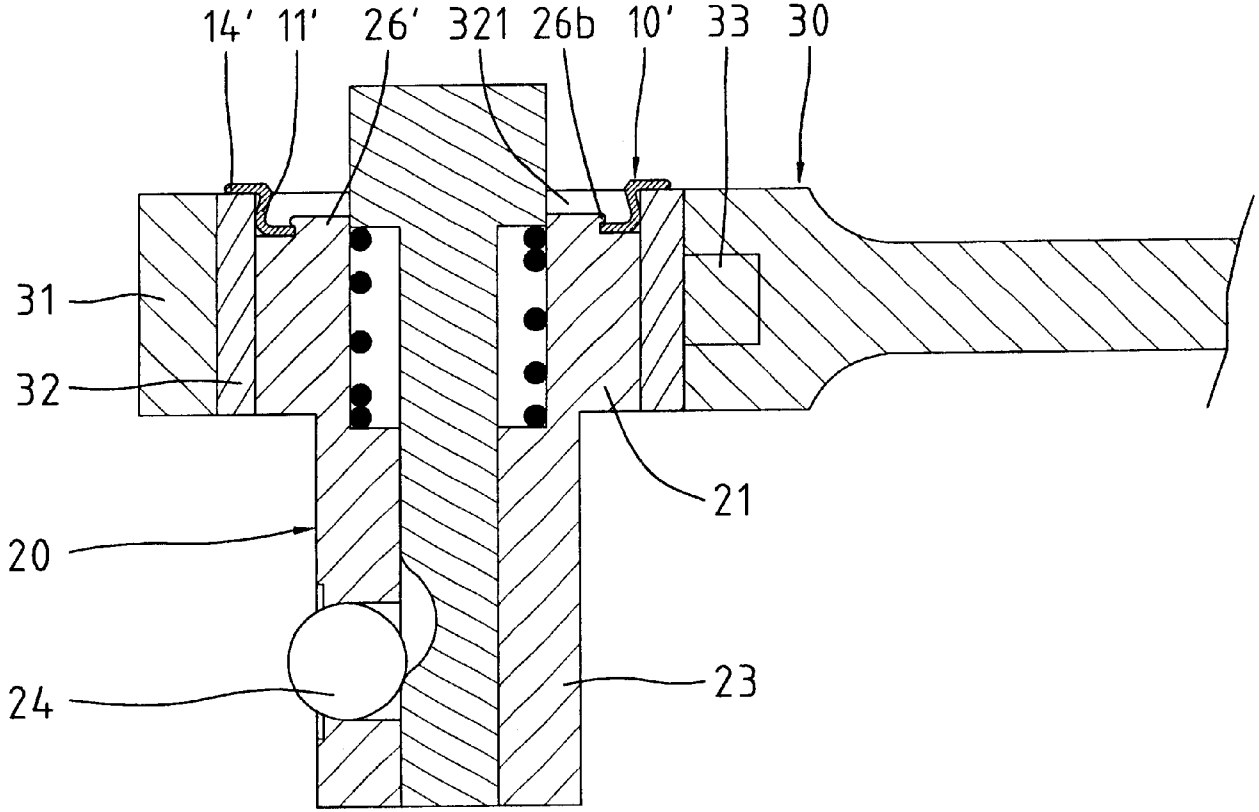
FIG. 8 is a sectional view of the wrench and the adaptor device in FIG. 6.

FIGS. 6 through 8 illustrate another modified embodiment of the adaptor device, wherein like numerals denote like elements. In this embodiment, the adaptor 20 includes a mounting section 26' on an end face of the first end 21 thereof. The retainer (now designated by 10') includes at least two resilient retaining sections 11' on an outer periphery thereof. In this embodiment, a plurality of radially extending resilient retaining sections 11' is formed along the outer periphery of the retainer 10' with a slit 12' being defined between each two retaining sections 11' that are adjacent to each other. Thus, each of the resilient retaining sections 11' has its resiliency. Each resilient retaining section 11' is preferably convex in an intermediate portion thereof and extends in a direction perpendicular to a general plane of the retainer 10'. Further, at least one of the resilient retaining sections 11' has a stop 14'extending from a distal end thereof along a plane parallel to the general plane of the retainer 10'. In this embodiment, each resilient retaining section 11' has a stop 14' extending from the distal end thereof. The retainer 10' is mounted around the mounting section 26' which is then riveted to form an annular lip 26*b* for fixing the retainer 10' to the adaptor 20.

In assembly, referring to FIG. 8, the second end 23 of the adaptor 20 is inserted from an end of the drive member 32 through the hole 321 of the drive member 32 until the stops 14' abut a side (i.e., an end face of the end) of the drive member 32 (or a side of the box end 31 if no drive member 32 is used) to prevent excessive insertion of the adaptor 20. A larger force is required to force the resilient retaining sections 11' to pass through the end of the drive member 32. The resilient retaining sections 11' are compressed inward. It is noted that a diameter of the annularly disposed resilient retaining sections 11' is greater than a diameter of the hole 321 of the drive member 32, it is impossible to disengage the adaptor 20 from the drive member 32 unless a relatively large force is applied in a direction opposite to the mounting direction. Thus, the wrench 30 can be used with a socket through the use of the retainer 10'.

Figure 9:
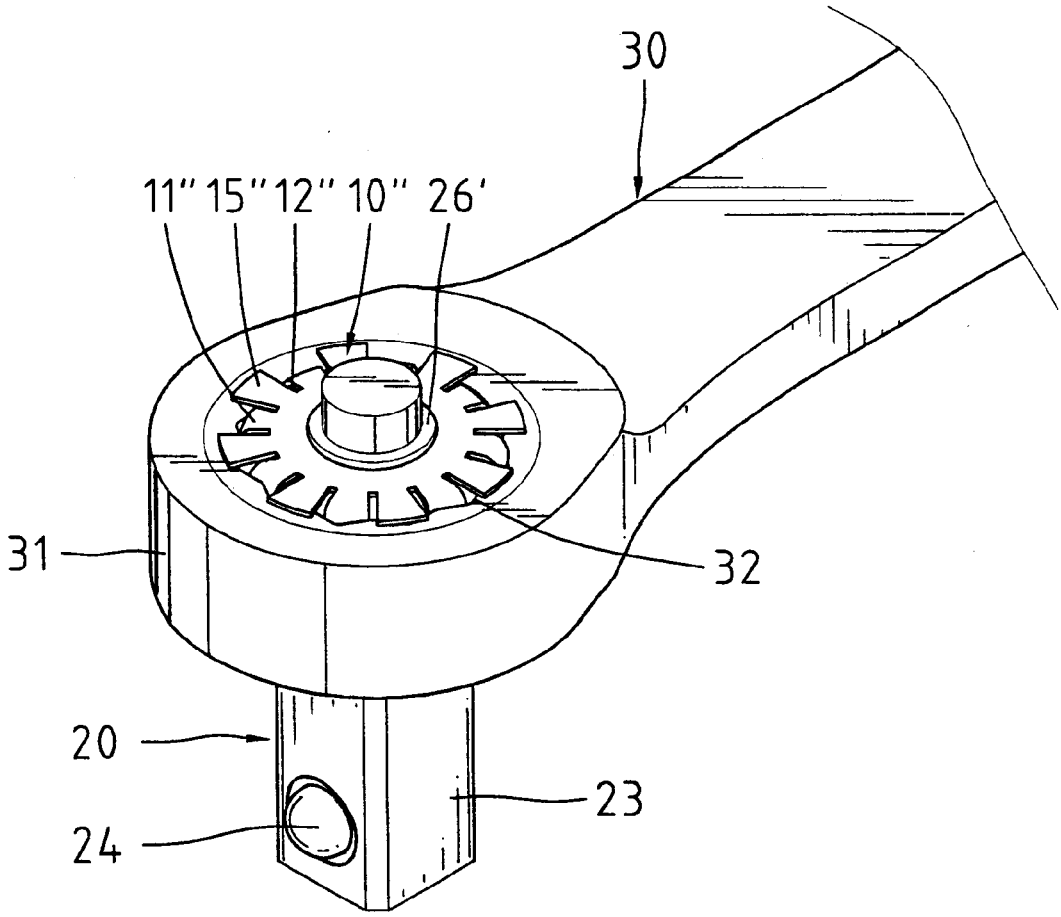
FIG. 9 is a perspective view of a wrench and a further modified embodiment of the adaptor device in accordance with the present invention.
Figure 10:
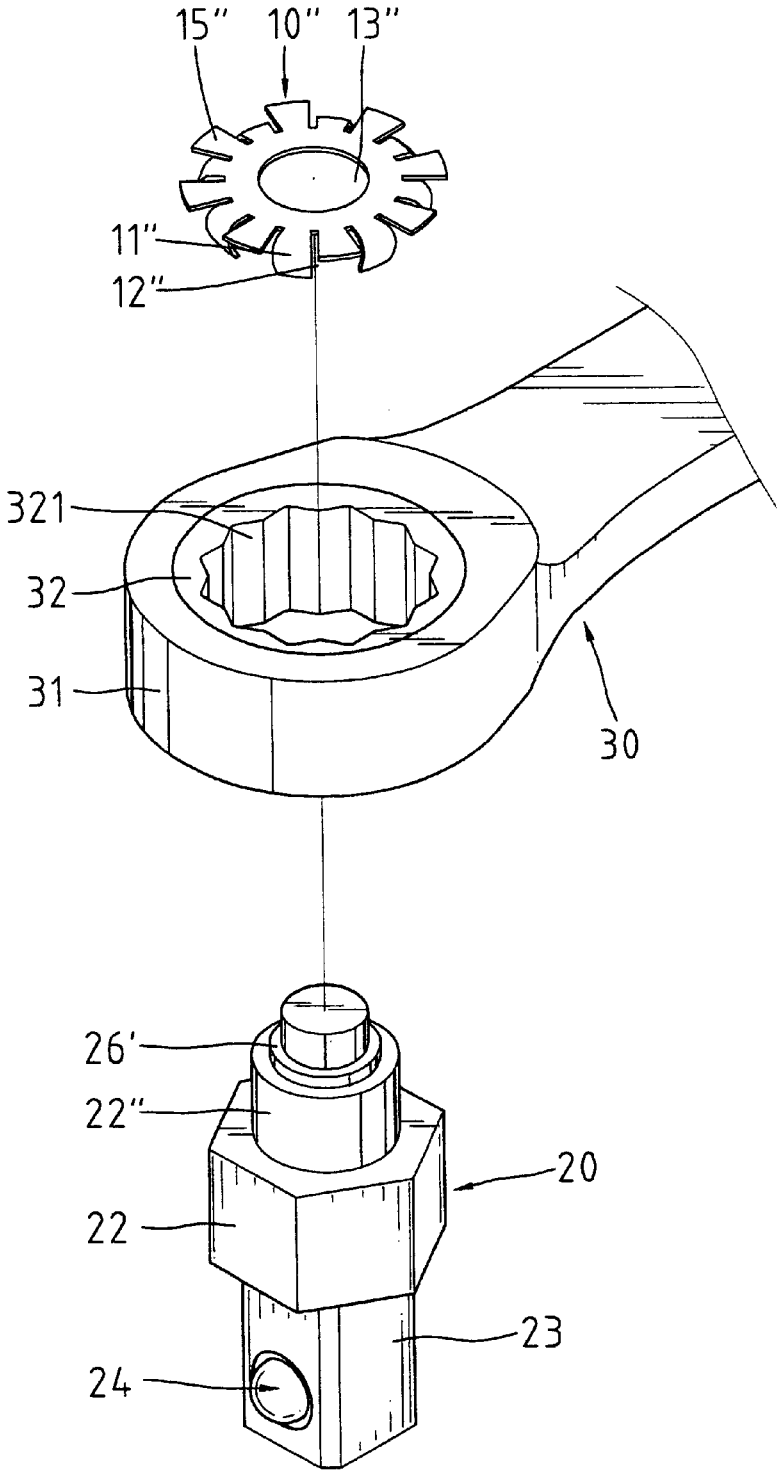
FIG. 10 is an exploded perspective view of the wrench and the adaptor device in FIG. 9.
Figure 11:
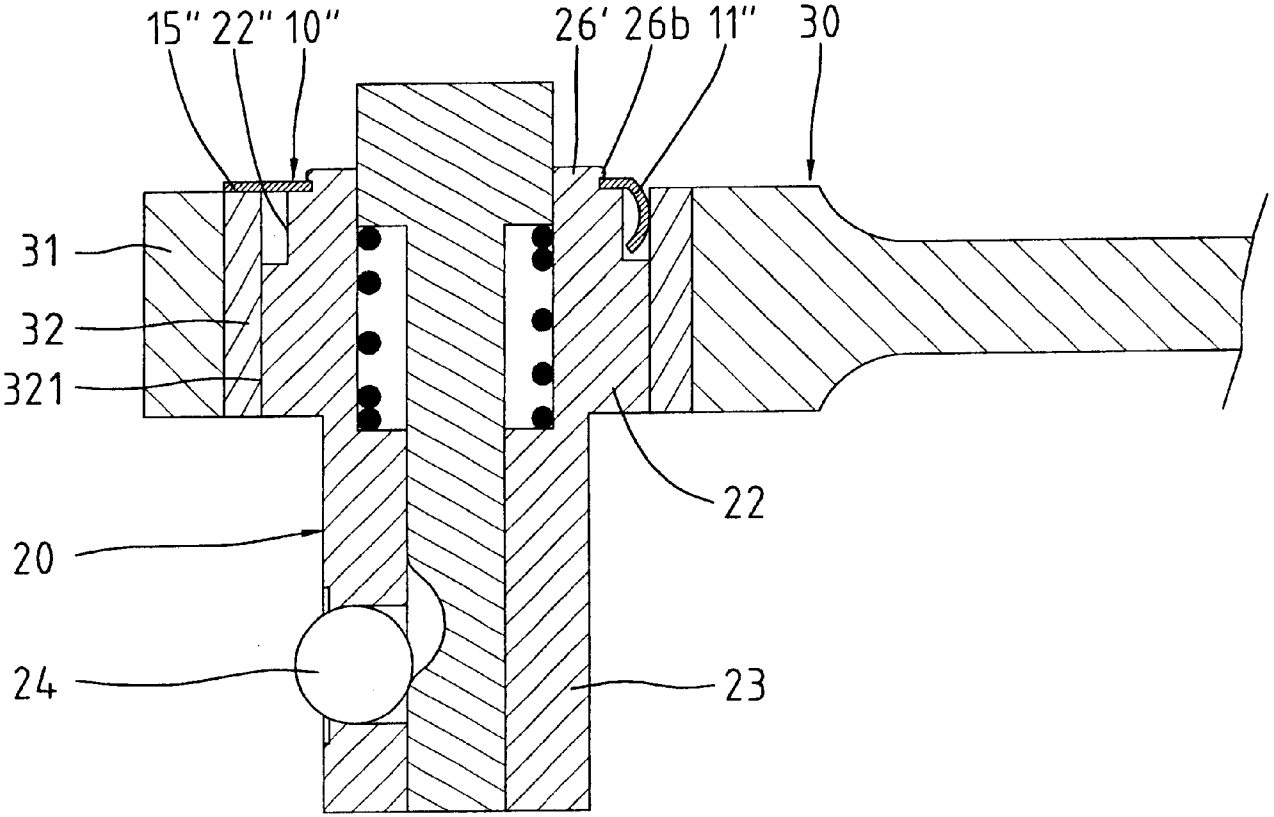
FIG. 11 is a sectional view of the wrench and the adaptor device in FIG. 9.

FIGS. 9 through 11 illustrate a further modified embodiment of the adaptor device modified from the embodiment of FIGS. 6 through 8, wherein like numerals denote like elements. In this embodiment, the adaptor 20 includes a mounting section 26' on an end face of the first end 21 thereof. The retainer (now designated by 10") includes at least two resilient retaining sections 11" on an outer periphery thereof and at least one stop 15" on the outer periphery thereof. In this embodiment, a plurality of radially extending resilient retaining sections 11" and a plurality of stops 15" are alternately disposed along the outer periphery of the retainer 10" with a slit 12" being defined between each retaining section 11" and an associated stop 15". Each resilient retaining section 11" is preferably convex in an intermediate portion thereof and extends in a direction perpendicular to a general plane of the retainer 10". Further, each stop 15" extends along a plane parallel to (including coincident with) the general plane of the retainer 10". The retainer 10" is mounted around the mounting section 26' which is then riveted to form an annular lip 26*b* for fixing the retainer 10" to the adaptor 20. Further, the engaging portion 22 of the adaptor 20 includes a reduced section 22".

In assembly, referring to FIG. 11, the second end 23 of the adaptor 20 is inserted from an end of the drive member 32 through the hole 321 of the drive member 32 until the stops 15" abut a side of the drive member 32 (or a side of the box end 31 if no drive member 32 is used) to prevent excessive insertion of the adaptor 20. A larger force is required to force the resilient retaining sections 11" to pass through the end of the drive member 32. The resilient retaining sections 11" are compressed inward and located in a space between the reduced section 22" of the engaging portion 22 of the adaptor 20 and the inner periphery defining the hole 321 of the drive member 32 (or the inner periphery of the box end 31 if no drive member 32 is used). It is noted that a diameter of the annularly disposed resilient retaining sections 11" is greater than a diameter of the hole 321 of the drive member 32, it is impossible to disengage the adaptor 20 from the drive member 32 unless a relatively large force is applied in a direction opposite to the mounting direction. Thus, the wrench 30 can be used with a socket through the use of the retainer 10".

Although the invention has been explained in relation to its preferred embodiment, it is to be understood that many other possible modifications and variations can be made without departing from the scope of the invention as hereinafter claimed.

What is claimed is:

1. An adaptor device adapted to be removably mounted in a box end of a wrench, the adaptor device comprising:

an adaptor including a first end adapted to be removably mounted in a box end of a wrench and a second end adapted to be releasably engaged with an object; and a retainer fixed to the first end of the adaptor, the retainer including a plurality of radially extending resilient retaining sections on an outer periphery thereof, a slit being defined between two of said resilient retaining sections that are adjacent to each other, said resilient retaining sections being adapted to engage with an inner periphery of the box end of the wrench, thereby providing an engaging force between the resilient retaining sections and the box end, at least one of said resilient retaining sections including a stop adapted to abut against an end face of the box end of the wrench.

2. The adaptor device as claimed in claim 1, wherein the retainer is riveted to an end face of the first end of the adaptor.

3. The adaptor device as claimed in claim 1, wherein each said resilient retaining section is preferably convex in an intermediate portion thereof and extends in a direction perpendicular to a general plane of the retainer.

4. The adaptor device as claimed in claim 1, wherein said resilient retaining sections being annularly disposed and having a diameter greater than an inner diameter of the box end of the wrench.

5. The adaptor device as claimed in claim 1, wherein the object is a socket.

6. An adaptor device adapted to be removably mounted in a box end of a wrench, the adaptor device comprising:

an adaptor including a first end adapted to be removably mounted in a box end of a wrench and a second end adapted to be releasably engaged with an object; and a retainer fixed to the first end of the adaptor, the retainer including a plurality of radially extending resilient retaining sections and a plurality of stops alternately formed on an outer periphery thereof, a slit being defined between each said resilient retaining section and an associated one of said stops, said resilient retaining sections being adapted to engage with an inner periphery of the box end of the wrench, thereby providing an engaging force between the resilient retaining sections and the box end, said stops being adapted to abut against an end face of the box end of the wrench.

7. The adaptor device as claimed in claim 6, wherein the retainer is riveted to an end face of the first end of the adaptor.

8. The adaptor device as claimed in claim 7, wherein each said resilient retaining section is preferably convex in an intermediate portion thereof and extends in a direction perpendicular to a general plane of the retainer.

9. The adaptor device as claimed in claim 8, wherein each said stop extends in a plane parallel to the general plane of the retainer.

10. The adaptor device as claimed in claim 8, wherein the first end of the adaptor includes a reduced section, said resilient retaining section being located in a space between the inner periphery of the box end of the stop and the reduced section of the adaptor.

11. The adaptor device as claimed in claim 6, wherein said resilient retaining sections being annularly disposed and having a diameter greater than an inner diameter of the box end of the wrench.

12. The adaptor device as claimed in claim 6, wherein the object is a socket.

13. A combination of an adaptor device and a wrench, the combination comprising:

a wrench having a box end, the box end having a first end and a second end opposite to the first end;

an adaptor including a first end removably mounted in the box end of the wrench and a second end adapted to be releasably engaged with an object, the first end of the adaptor including a flange abutting against an end face of the first end of the box end of the wrench, the adaptor further including a mounting section between the first end of the adaptor and the second end of the adaptor; and a retainer fixed to the mounting section of the adaptor, the retainer including at least two resilient retaining sections on an outer periphery thereof, a slit being defined between said at least two resilient retaining sections, said at least two resilient retaining sections abutting against the second end of the box end of the wrench, thereby providing an engaging force between the resilient retaining sections and the box end.

14. The combination as claimed in claim 13, wherein the retainer is riveted to the mounting section of the adaptor.

15. The combination as claimed in claim 13, wherein the second end of the adaptor is inserted through the box end until the retainer is completely passed through the box end, said at least two resilient retaining sections being compressed while passing through the box end, said at least two resilient retaining sections resuming their shapes after passing through and abutting the second end of the box end.

16. The combination as claimed in claim 13, wherein each resilient retaining section is convex in an intermediate portion thereof and extends in a direction perpendicular to a general plane of the retainer.

17. The combination as claimed in claim 13, wherein the object is a socket.

* * * * *